US006085676A

United States Patent [19]

Ninomiya

[11] Patent Number: 6,085,676

[45] Date of Patent: Jul. 11, 2000

[54] PATTERN STITCHING SEWING MACHINE

[75] Inventor: Masashi Ninomiya, Hachioji, Japan

[73] Assignee: Janome Sewing Machine Co., Ltd., Tokyo, Japan

[21] Appl. No.: 09/374,676

[22] Filed: Aug. 16, 1999

[30] Foreign Application Priority Data

Sep. 22, 1998 [JP] Japan ..... 10-284755

[51] Int. Cl.[7] ..... D05B 3/02

[52] U.S. Cl. ..... 112/444; 112/462

[58] Field of Search ..... 112/444, 459, 112/462, 464, 448, 458

[56] References Cited

U.S. PATENT DOCUMENTS 4,064,817 12/1977 Sawada et al. ..... 112/444
4,947,774 8/1990 Rendahl et al. ..... 112/444

*Primary Examiner*—Peter Nerbun
*Attorney, Agent, or Firm*—Nields, Lemack & Dingman

[57] ABSTRACT

A pattern stitching sewing machine is disclosed, wherein a pattern selecting device including a pattern selecting dial is rotatingly operated to select at least one of a plurality of different patterns pattern. First and second indication means are operated in association with operation of the pattern selecting device to indicate a pattern selected by the pattern selecting and an adjustment scope of the selected pattern with respect to at least one of the stitch width and the work feeding amount respectively.

3 Claims, 4 Drawing Sheets

PATTERN STITCHING SEWING MACHINE

BACKGROUND OF THE INVENTION AND RELATED ART STATEMENT

1. Field of the Invention

The invention relates to a pattern stitching sewing machine and more particularly relates to indication mechanisms which are operated in association with a pattern selecting device to indicate a selected pattern and the adjustment scope of the selected pattern with respect to at least one of the stitch width and the work feeding amount.

2. Prior Art

The pattern stitching sewing machine having a stitch width adjusting mechanism and a work feeding amount adjusting mechanism is generally known. The sewing machine of this type can stitch various patterns including zigzag stitch patterns, button-hole stitch patterns and so on under the control of such adjusting mechanisms with appropriate stitch width and work feeding amount (stitch density) specific to each of the patterns to be stitched.

However, the sewing machine in the recent years has come to be able to stitch a great number of different stitch patterns. In fact, it is very difficult for the user to adjust the sewing machine in accordance with the conditions, each specifically required to each of the stitch patterns.

OBJECTS OF THE INVENTION

The invention has been provided to eliminate the defects and disadvantages of the prior art. It is, therefore, a principal object of the invention to provide a pattern stitching sewing machine which may indicate the stitch conditions, each specific to each of the stitch patterns to be stitched when each pattern is selected.

It is another object of the invention to enable the user to adjust the sewing machine in reference to the indicated condition with respect to a selected stitch pattern instead of taking troubles to refer to the manual of the sewing machine.

It is another object of the invention to provide a sewing machine having a stitch information indicating mechanism which is mechanically simple and compact and is operated in association with a pattern selecting operation.

SUMMARY OF THE INVENTION

In short, the invention substantially comprises a pattern selecting device including a pattern selecting dial rotatingly operated to select at least one of a plurality of different patterns; a stitch forming device including a stitch width adjusting mechanism and a feeding amplitude adjusting mechanism for forming and adjusting the stitches of a selected pattern; a first indication means operated in association with the pattern selecting device to indicate a pattern selected by the pattern selecting device; and a second indication means operated in association with the pattern selecting device to indicate the adjustment scope for at least one of the stitch width and the feeding amplitude for a pattern selected by said pattern selecting device.

DETAILED DESCRIPTION OF PREFERRED EMBODIMENT

The invention will now be described in reference to the attached drawings.

Figure 1:
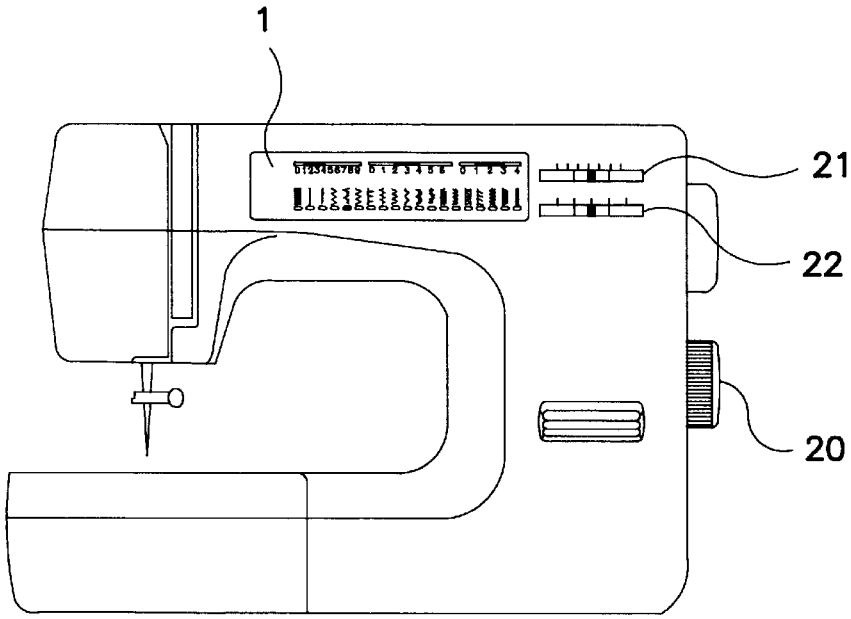
FIG. 1 is a front elevational view of a sewing machine having the invention incorporated therein.
Figure 5:
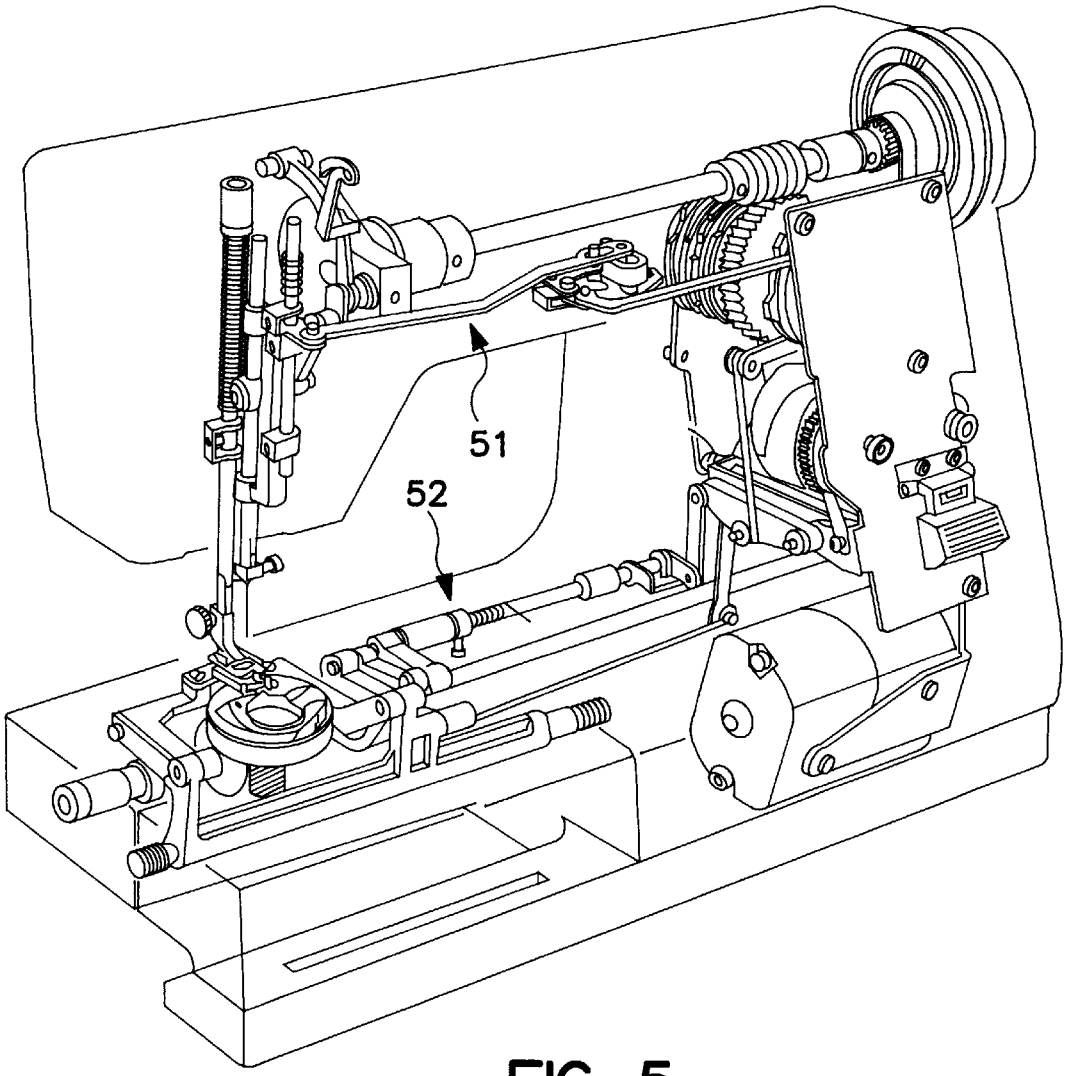
FIG. 5 is a perspective view of the sewing machine according to the invention showing the essential mechanisms for forming the stitches of a selected pattern.

In FIG. 1, An indication panel 1 is arranged on a machine arm. Levers 21 and 22 are arranged on one side of the indication panel 1. The lever 21 is manually operated to adjust the stitch width of a pattern to be stitched and the lever 22 is manually operated to adjust the stitch length or the feed amplitude of a work to be stitched. Pattern selecting dial 20 is provided on 6 one side of the sewing arm. The pattern selecting dial 20 is rotatingly operated to select a pattern which may be stitched by a stitch forming device as shown in FIG. 5. Namely, a stitch width control mechanism 51 and a feed amplitude control mechanism 52 are optionally adjusted to form the stitches of a selected pattern in accordance with a required condition.

Figure 2:
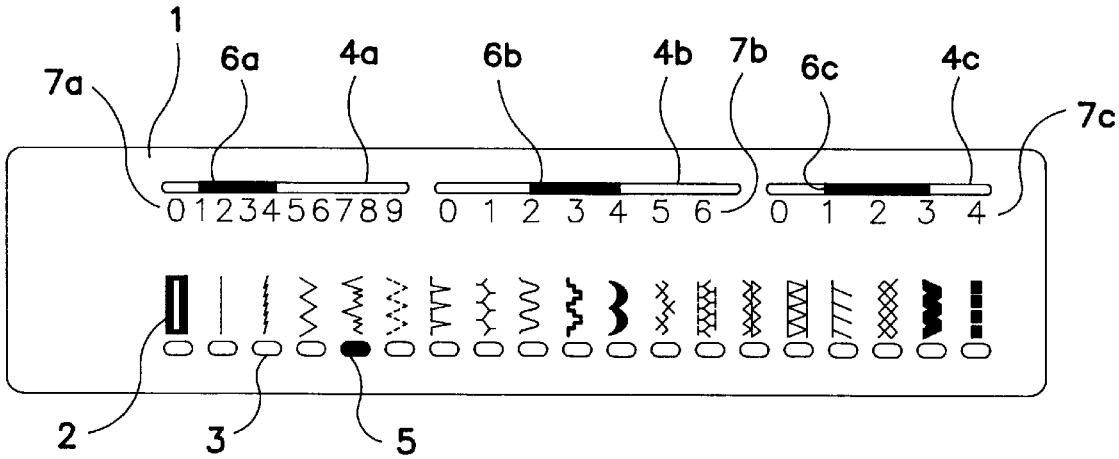
FIG. 2 is a plan elevational view of an indication panel of the sewing machine in FIG. 1, but shown in enlarged scale.

As shown in FIG. 2, the indication panel 1 has a group 2 of various patterns laterally depicted thereon including a button hole pattern, a zigzag pattern and so on to be optionally selected by operation of the pattern selecting dial 20. Each of the patterns has an indication window 3 arranged directly therebelow for indicating that the corresponding pattern has been selected. In this case, the selected pattern is indicated with the corresponding indication window being switched, for example, from blank to black.

The indication panel 1 has laterally elongated indication windows 4*a*, 4*b* and 4*c* laterally arranged thereon above the arrangement of the pattern indications 2. The indication windows 4*a* 4*b* and 4*c* are provided to show an adjustment scopes of the upper thread tension, the stitch width and the feed amplitude of the work respectively. Each of the adjustment scope indication windows 4*a*, 4*b* and 4*c* has a series of numerals 7*a* laterally arranged therebelow for practically defining the adjustment scope, for example, by rendering the windows from blank to black which may extend over optional numerals as shown by the reference numerals 6*a*, 6*b* and 6*c* respectively in FIG. 2.

Figure 3:
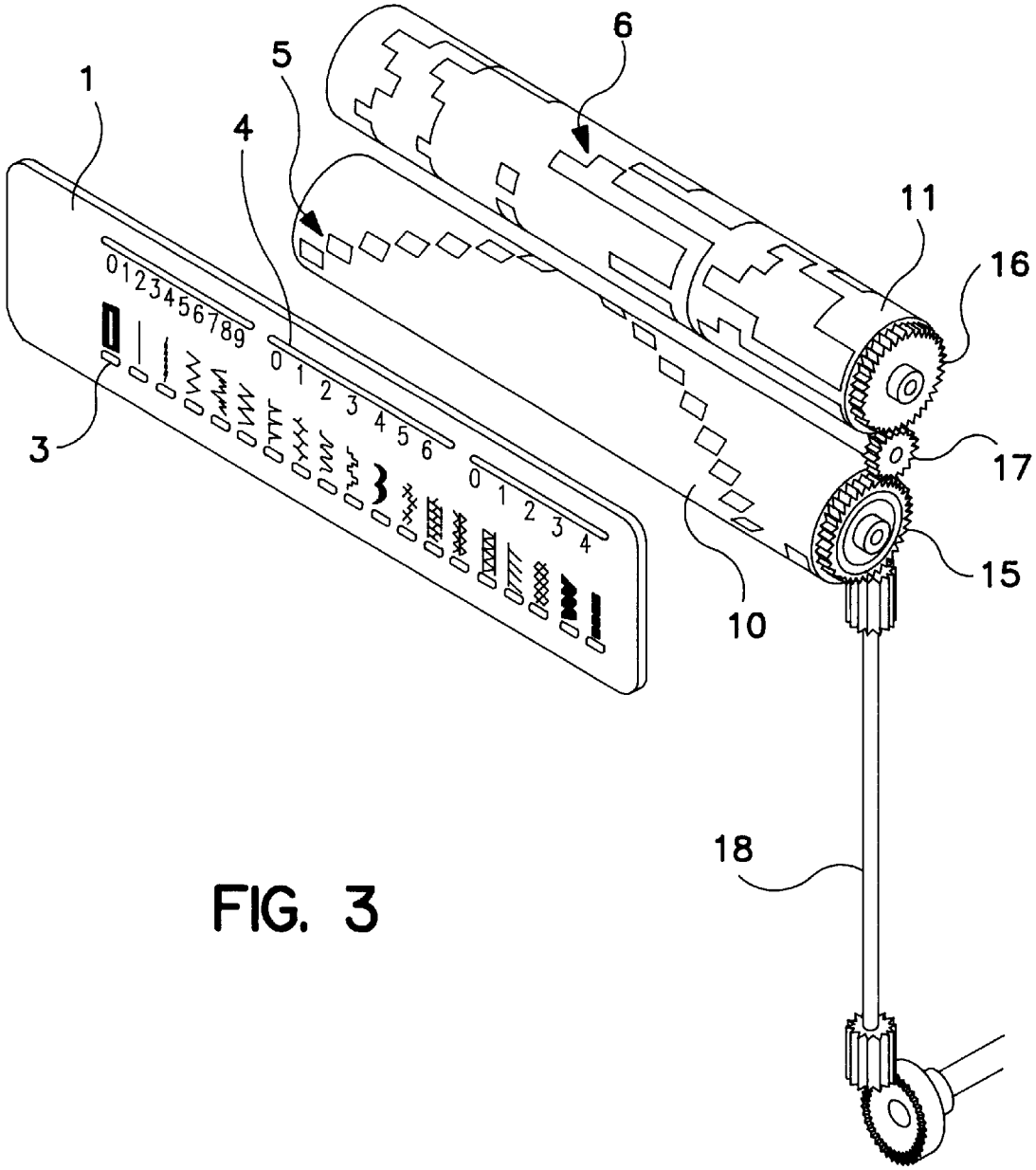
FIG. 3 is a perspective view of an indication mechanism according to the invention shown in connection with the indication panel.

In FIG. 3, a first elongated drum 10 and a second elongated drum 11 are provided within the machine arm. The first and second drum 10, 11 are operatively connected to the pattern selecting dial 20 by means of a transmission mechanism including a gear 15 fixed to one end of the first drum 10, a vertical shaft 18 which has an upper pinion in mesh with the gear 17 and a lower pinion in mesh with a gear which is connected to the pattern selecting dial 20, a gear 16 fixed to one end of the second drum 11 and an intermediate pinion 17 which is arranged between the gears 15 and 16 and being in mesh with these gears. Thus the first and second drums 10, 11 are rotated in association with each other with rotation of the pattern selecting dial 20.

The first drum 10 has a series of pattern selection indicating patterns 5 depicted in, for example, black on the surface thereof along a curved line extended axially thereof, so that the patterns 5 may come to the indication windows 3 and occupy the same respectively and alternatively as the pattern selecting dial 20 is rotated. On the other hand, the second drum 11 a series of adjustment scope selection indicating patterns 6 depicted in, for example, black on the surface thereof in extension in the peripheral and axial directions thereof, so that the patterns 6 may come to the adjustment scope indicating windows 4 and occupy the same respectively and alternatively and extend over a predetermined series of optimum numerals 7*a*, 7*b* and 7*c* in association with pattern selection indicating patterns 5 as the pattern selecting dial 20 is rotated.

Figure 4:
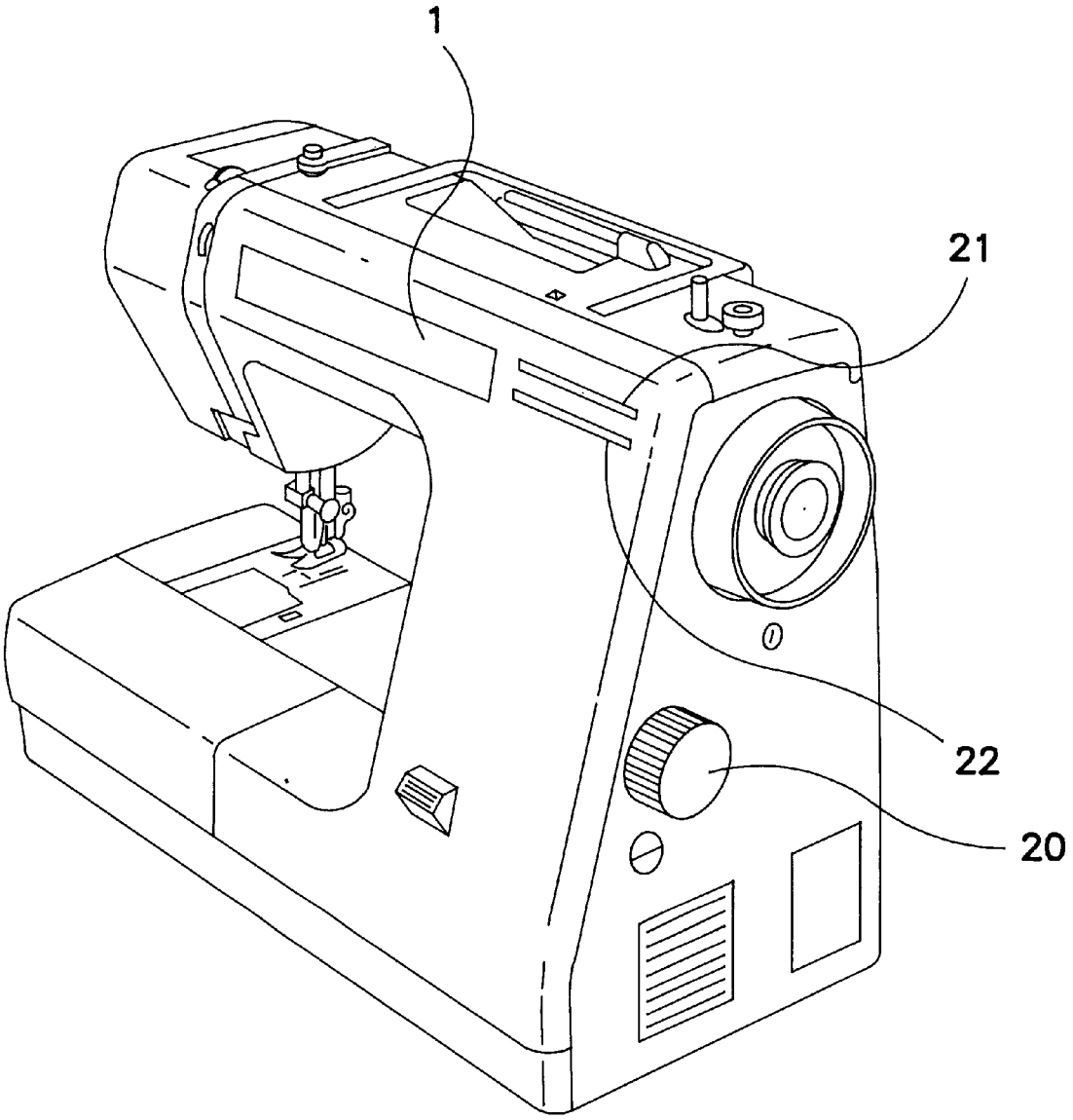
FIG. 4 is a perspective view of the sewing machine according to the invention shown in its entirety.

FIG. 4 shows a sewing machine having the indication panel 1, the pattern selecting dial 20 and adjusting levers 21, 22 provided at the respective positions thereof, so that with manual rotation of the pattern selecting dial 20, the user can select an optional one of the patterns 2 indicated on the indication panel 1 while the user sees the depicted patterns 2. In the meantime, the adjustment scopes are indicated in the adjustment scope indicating windows 4 respectively in association with the selected pattern to be stitched and in connection with the upper thread tension, the stitch width and the work feeding amplitude of the selected pattern. Then the user can operate the generally known upper thread tension adjusting device (not shown) to adjust the upper thread tension, and operate the adjusting levers 21 and 22 in reference to the indicated adjustment scopes as indicated to adjust the stitch width control mechanism 51 and the feed amplitude control mechanism 52 without referring to a manual of the sewing machine.

The drums 10 and 11 may be made of a light permeant material, and illuminators may be provided within the drums respectively such that the selected pattern and the adjustment scopes thereof may be indicated by illumination at the indication windows 5 and 6.

Further, the indication elements of this embodiment may be replaced by the electronics including a liquid crystal while the pattern selecting device is replaced by the electronics including a microcomputer.

The invention being thus described, it will be obvious that the same may be varied in many ways. Such variations are not regarded as a departure from the spirit and scope of the invention, and all modifications are intended to be included within the scope of the following claims.

What is claimed is:

1. A pattern stitching sewing machine having a pattern selecting device including a pattern selecting dial rotatingly operated to select at least one of a plurality of different patterns and a stitch forming device including a stitch width adjusting mechanism and a feeding amplitude adjusting mechanism for forming and adjusting the stitches of a selected pattern, said sewing machine comprising:

a machine arm;

a first indication means operated in association with said pattern selecting device to indicate a pattern selected by said pattern selecting device;

a second indication means operated in association with said pattern selecting device to indicate the adjustment scope for at least one of the stitch width and the feeding amplitude for a pattern selected by said pattern selecting device;

an indication panel arranged on said machine arm and having a series of different patterns depicted thereon extending laterally thereof;

a series of indication windows formed at said indication panel, each corresponding to each of said depicted patterns;

at least one elongated indication window formed at said indication panel;

wherein said first and second indication means are provided within said machine arm, said first indication means including a first elongated drum operatively connected to said pattern selecting means and having a first series of indicator elements depicted thereon along a curved line extending axially thereof for indicating a selected pattern, said second indication means including a second elongated drum operatively connected to said first drum and having a second series of indicator elements depicted thereon for indicating at least one of upper stitch tension, stitch width adjustment scope and the feed amplitude adjustment scope for a selected pattern, said first and second drums being rotated in response to rotating operation of said pattern selecting dial to bring one of said series of indicator elements to a corresponding one of said indication windows respectively and alternatively.

2. The sewing machine as defined in claim 1, wherein said first and second indication means are operatively connected to each other for movement in association with each other in response to operation of said pattern selecting device.

3. The sewing machine as defined in claim 1, wherein said adjustment scope is numerically indicated.

* * * * *